US009858779B2

(12) United States Patent
Schlake

(10) Patent No.: US 9,858,779 B2
(45) Date of Patent: Jan. 2, 2018

(54) FIREARM ALARM

(71) Applicant: Jeremy Eugene Schlake, Atlantic, IA (US)

(72) Inventor: Jeremy Eugene Schlake, Atlantic, IA (US)

( * ) Notice: Subject to any disclaimer, the term of this patent is extended or adjusted under 35 U.S.C. 154(b) by 0 days.

(21) Appl. No.: 15/161,140

(22) Filed: May 20, 2016

(65) Prior Publication Data

US 2017/0186287 A1 Jun. 29, 2017

(51) Int. Cl.
*G08B 13/14* (2006.01)
*F41C 27/00* (2006.01)

(52) U.S. Cl.
CPC ..... *G08B 13/1472* (2013.01); *F41C 27/00* (2013.01)

(58) Field of Classification Search
None
See application file for complete search history.

(56) References Cited

U.S. PATENT DOCUMENTS 5,196,827 A * 3/1993 Allen et al. ..... 340/568
6,177,876 B1 * 1/2001 Krueger ..... 340/666
6,400,269 B1 * 6/2002 Savastano ..... 340/568.1
7,116,224 B2 * 10/2006 Mickler ..... 340/568.1

* cited by examiner

*Primary Examiner* — Brent Swarthout

(57) ABSTRACT

The Firearm Alarm is a pressure-plate activated alarm switch to provide a functional and operational response to handguns being handled in a home. The design of the Firearm Alarm allows for mobility and placement in almost any type of setting. The alarm is a high decibel alarm that can access any part of most homes, even through closed doors and walls. The Firearm Alarm also allows for a tiered defense of a firearm such as using it in conjuncture with trigger locks and weapon safes.

3 Claims, 2 Drawing Sheets

Firearm Alarm Parts Breakout

Specification Example
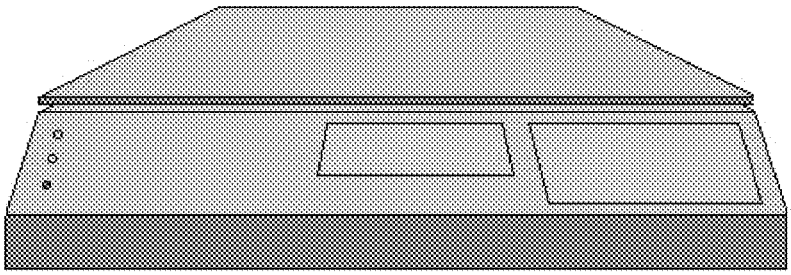
Figure 1: Firearm Alarm Illustration

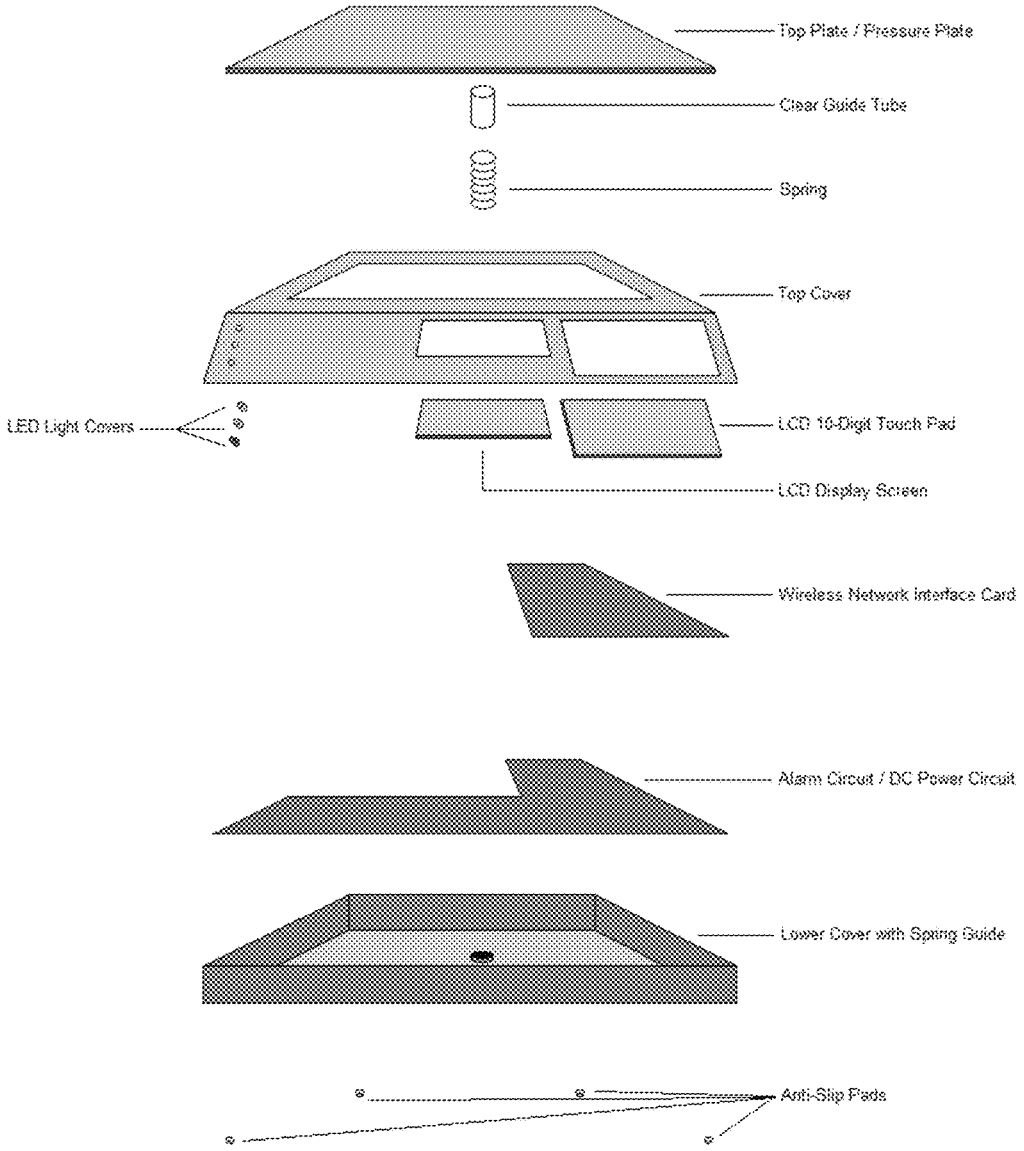
Figure 2: Firearm Alarm Parts Breakout

FIREARM ALARM

TECHNICAL FIELD

The Firearm Alarm is a device that is a firearm safety device. The device does not focus on the aspect of preventing access but is able to supplement that benefit. The Firearm Alarm is designed to provide notification anytime a firearm has been handled.

BACKGROUND ART

Approximately 54% of all firearm related deaths occur in the home where the firearm is kept. A majority of all unintentional firearm deaths involving children occurred while an adult was at the residence. With these statistics it is clear that conventional storage techniques fail to keep children safe from firearms. There are many different things that can cause this failure.

First, many gun owners do not use safes for all of their weapons, even if they own one. The primary reason this occurs is due to the desire to have their weapons available in case they need it in an emergency. Even when safes are used, children know where keys are kept and can figure out combinations easily. In some cases, a safe can be opened with straws or paper clips.

Although many companies try to get people to protect their families by protecting their firearms, there is no fail-safe method to keep a firearm out of a child's hands. In many times where accidental firearm discharge occurred, the child was able to access the firearm in either safes or unsecured settings and did not fire the weapon until moments after the action of picking up the weapon. Typically in these cases, an adult is present at the residence during these accidental discharges.

Situations like this require prevention techniques but also need to be buttressed with other methods. Currently, there is no notification method to allow firearm owners knowledge that their weapon has been handled. The Firearm Alarm addresses this safety vulnerability.

DISCLOSURE OF INVENTION

The Firearm Alarm is designed to place a handgun on top of it. Placing a handgun on top of the Firearm Alarm pressure plate found at the top of the device depresses a spring located in the middle of the device and directly underneath the pressure plate. When the pressure plate is fully depressed, the alarm is activated. When the firearm has been removed from the pressure plate, the pressure plate is sent to the beginning, extended state and breaks the connection between the connection points attached to the pressure plate and the circuitry found inside the Firearm Alarm. The alarm circuitry connects to a high decibel speaker and sends out an audible alert loud enough to be heard in a large home or open area. A secondary set-up allows for the Firearm Alarm pressure plate to be connected to a weight detection circuit that allows for weight variances to determine if the handgun has been removed.

The Firearm Alarm does not have a setting to turn off the alarm to ensure that the alarm is always present in the event of handling the without authorization. The device also contains circuitry to add an extra layer of security. Users can program the Firearm Alarm to send text messages to their phone. The Firearm Alarm contains network circuitry to allow for a wireless or wired network connection through a broadband connection or a router.

The Firearm Alarm can only be deactivated after inputting a code. The code is only able to be inputted after the alarm has been triggered. This avoids children from disabling the Firearm Alarm prior to handgun removal. This feature also allows the capability of dialing 911 if desired by the user. This feature provides for faster emergency response in the case of accidental discharge or allows quicker police response during home invasions. Inputting the code sends a clear signal to emergency responders notifying that there is no need for police or medical response.

The Firearm Alarms design allows for placement in many different locations. Its streamline design allows for placement in safes, drawers, or on table tops. It also gives users the capability of travelling with it and not taking much space. This is very beneficial especially during hotel stays or camping trips. Ease of use is another benefit to the design; the large LCD display provides high-visibility for code and menu navigation. The LCD touch pad is large enough to feature large-print numbers for use by any type of consumer.

DRAWING DESCRIPTIONS

In FIG. 1 in the Firearm Alarm Drawing document, an overview of the front of the device is shown. The three LED lights on the left provide different visual verification during the set-up of the device through its menu-driven programming. The middle LCD display shows menus, code input, and welcome messages. It also displays remaining battery life through graphical representation. The far right LCD display is a press-to-turn-on 12- to 14-button display for digital push button configuration and code input. The area next to the LEDs is left blank for brand logos.

A generalized parts breakout is given in FIG. 2 in the Firearm Alarm Drawing document. Starting at the top of the figure, the Top Plate/Pressure Plate shows where the handgun is placed. This material is designed out of strong aluminum to ensure low wear but light weight. The Clear Guide Tube directly under the Pressure Plate ensures low-risk of the spring binding or moving away from the pressure plate. The Spring allows for quick return to the original position of the Pressure Plate. The contacts for the alarm will be found underneath the Pressure Plate, through the center of the Clear Tube Guide and Spring, and at the bottom of the Lower Cover with Spring Guide.

The Top Cover can be made out of Number 5 plastic or heavy gauged aluminum. This provides protection to the internal components and avoids risk of damage from falls or items being dropped on the device. The LED Light Covers are inserted into the Top Cover and are attached using adhesive to avoid the LED Light Covers from falling into the device. The two LCD displays (LCD Display Screen and LCD 10-Digit Touch Pad) are attached to the Top Cover using screws from the inside of the device. The LCD displays are connected to the internal circuitry through ribbon cables.

The Wireless Network Interface'Card connects to the Alarm Circuit/DC Power Circuit card through various ribbon cables ran on the outside edge of the circuit cards. The Wireless Network Interface Card is in line with an RJ-45 connector hole at the rear of the Lower Cover with Spring Guide. This allows for connection of a separate CAT-5/5e/6 network cable. Underneath the Wireless Network Interface Card is the primary Alarm Circuit/DC Power Circuit card. This card is where the alarm circuit is located and provides the primary power to the device. The LCD displays connect to this circuit board.

The Alarm Circuit/DC Power Circuit card lines up with a power connector hole on the rear of the Lower Cover with Spring Guide to allow for an AC power cable to be connected. The DC Power Circuit portion of the circuit card connects with a 9-volt battery terminal on the rear, left section of the Lower Cover with Spring Guide. The area on the Lower Cover with Spring Guide directly underneath the 9-volt battery terminal opens for a 9-volt battery cover. This allows the device to run on either battery or AC power. All AC power provided by the AC power adapter is converted on the DC Power Circuit.

At the bottom of the device is a aluminum chassis called the Lower Cover with Spring Guide. There are four Anti-Slip Pads constructed from rubberized material to keep the device in place and to avoid false alarm conditions due to accidental movement to the device. Inside the Lower Cover with Spring Guide is a spring guide that the Clear Guide Tube rests. The alarm contacts are found inside the Spring Guide portion of the Lower Cover with Spring Guide and connect by small gauged wire to the Alarm Circuit/DC Power Circuit.

INDUSTRIAL APPLICABILITY

Aside from the use of handguns with the device, the device can also be utilized in various areas around the home and office. The device can be used as an anti-theft device of items of interest. Jewelry or other high-valued items can be placed on top of the Firearm Alarm while inside or out of a safe to allow for notification through audible alarm or text message when the item has been removed. The device can also be used to display the weight of an item if weight detection circuitry is placed inside of the device instead of alarm contacts.

The invention claimed is:

1. An electronic pressure plate device to sense a firearm removal comprising of:

A top plate where a firearm is placed on top forcing said top plate down to arm an alarm circuit;

A top cover and a bottom cover which contain and protect internal circuitry which are connected through the use of clips molded into the covers;

Colored light emitting diode covers to provide visual status of the device;

A liquid crystal diode display to provide users display of menu options and error readouts;

A 10-digit liquid crystal diode touch panel to allow users menu-driven selection options and alarm reset capability;

A wireless network interface card allowing users to connect to a wireless network to allow for short message service text alerts or emergency service auto-dialing;

A circuit card containing both the alarm circuit and an associated DC power circuit which powers the device and provides the device the necessary electronic components for audio, visual, and electronic alerts of a firearm being removed from the top plate and to allow software storage;

Wiring allowing connection of alarm circuit, card, top plate, diodes, display, power circuit and touch panel;

A clear tube guide located between the top cover and bottom cover allowing the top plate to rest inside the device and make connection to the alarm circuit every time it is depressed;

A spring which the top plate rests on and found within the clear tube guide that extends the top plate back to an original position when a firearm is removed from the device activating the alarm circuit;

An access cover located on the bottom cover on the left, rear portion of the bottom cover that allows battery access to the device;

And four anti-slip pads located on the external corners of the bottom cover to keep the device from sliding around flat surfaces.

2. An electronic pressure plate device as outlined in claim 1 further comprising: a printed electronic circuit board to hold first electronic components that serve to provide activation of alerts of a firearm being removed from the top plate;

Second electronic components to provide electrical signals for an audible alert notification;

Third electronic components to provide the user access to the touch panel;

And a piezo buzzer rated at 85 dB to broadcast an audible alert.

3. An electronic pressure plate device as outlined in claim 1, the wireless network interface card further comprising:

A printed electronic circuit board to hold communication path electronic components to provide a communication path for text and emergency service notifications;

Connectivity electronic components that serve to provide wireless connectivity for text alerts and emergency service notifications;

Fourth electronic components to provide program storage to send notifications through network connectivity;

And a RJ-45 connector that provides network connection through phone or internet lines.

* * * * *